US012599168B2

(12) United States Patent
Bialek et al.

(10) Patent No.: US 12,599,168 B2
(45) Date of Patent: Apr. 14, 2026

(54) CARTRIDGE COMPRISING NICOTINE AND A WATER-IMMISCIBLE SOLVENT

(71) Applicant: Philip Morris Products S.A., Neuchatel (CH)

(72) Inventors: Jakub Bialek, Neuchatel (CH); Jean-Pierre Schaller, Neuchatel (CH); Aline Vuarnoz-Bize, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 816 days.

(21) Appl. No.: 17/621,325

(22) PCT Filed: Jun. 4, 2020

(86) PCT No.: PCT/EP2020/065498
§ 371 (c)(1),
(2) Date: Dec. 21, 2021

(87) PCT Pub. No.: WO2020/259977
PCT Pub. Date: Dec. 30, 2020

(65) Prior Publication Data

US 2022/0304374 A1 Sep. 29, 2022

(30) Foreign Application Priority Data

Jun. 25, 2019 (EP) ..... 19182410

(51) Int. Cl.
*A24F 40/10* (2020.01)
*A24B 15/167* (2020.01)
(Continued)

(52) U.S. Cl.
CPC ..... *A24F 40/10* (2020.01); *A24B 15/167* (2016.11); *A24B 15/243* (2013.01); *A24B 15/32* (2013.01); *A24F 40/30* (2020.01); *A24F 40/42* (2020.01)

(58) Field of Classification Search
None
See application file for complete search history.

(56) References Cited

U.S. PATENT DOCUMENTS

2006/0018840 A1 1/2006 Lechuga-Ballesteros et al.
2014/0345631 A1 11/2014 Bowen et al.
(Continued)

FOREIGN PATENT DOCUMENTS

CN 105263345 A 1/2016
CN 106714589 A 5/2017
(Continued)

OTHER PUBLICATIONS

Fagerström, K., "Nicotine: Pharmacology, Toxicity and Therapeutic use", Journal of Smoking Cessation 2014, 9, pp. 53-59.
(Continued)

*Primary Examiner* — Philip Y Louie
*Assistant Examiner* — Jeffrey A. Buckman
(74) *Attorney, Agent, or Firm* — Oblon, McClelland, Maier & Neustadt, L.L.P.

(57) ABSTRACT

A cartridge for an aerosol-generating system is provided, the cartridge containing: a first liquid formulation including at least one of water and one or more water-miscible solvents; and a second liquid formulation including one or more water-immiscible solvents having a water solubility at 20° C. of less than or equal to about 100 mg/ml, in which at least one of the first liquid formulation and the second liquid formulation comprises nicotine. An aerosol-generating system is also provided, including the cartridge; and an aerosol-generating device including one or more atomizers configured to generate an aerosol from the first liquid formulation and the second liquid formulation contained in the cartridge.

15 Claims, 1 Drawing Sheet

Figure 1A:
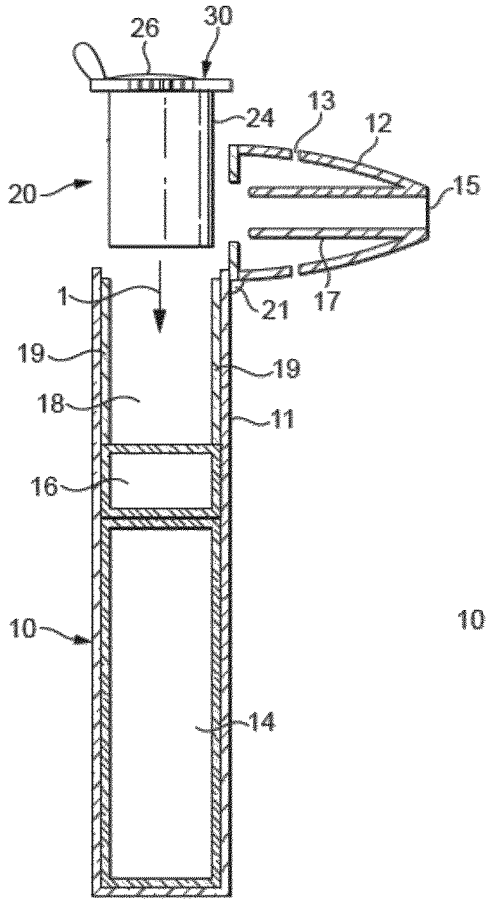

(51) Int. Cl.

| | |
|---|---|
| ***A24B 15/24*** | (2006.01) |
| ***A24B 15/32*** | (2006.01) |
| ***A24F 40/30*** | (2020.01) |
| ***A24F 40/42*** | (2020.01) |

(56) References Cited

U.S. PATENT DOCUMENTS

| | | | | |
|---|---|---|---|---|
| 2015/0020824 | A1 | 1/2015 | Bowen et al. | |
| 2015/0313275 | A1 | 11/2015 | Anderson et al. | |
| 2016/0044967 | A1 | 2/2016 | Bowen et al. | |
| 2016/0044968 | A1 | 2/2016 | Bowen et al. | |
| 2016/0286862 | A1* | 10/2016 | Silvetrini | A24F 40/485 |
| 2017/0086500 | A1 | 3/2017 | Li et al. | |
| 2017/0172204 | A1 | 6/2017 | Kane et al. | |
| 2019/0124982 | A1* | 5/2019 | Atkins | A61M 11/042 |

FOREIGN PATENT DOCUMENTS

| | | | |
|---|---|---|---|
| CN | 108289496 | A | 7/2018 |
| CN | 108601397 | A | 9/2018 |
| CN | 109068742 | A | 12/2018 |
| EP | 3 135 136 | A1 | 3/2017 |
| JP | 2016-520061 | A | 7/2016 |
| JP | 2018-527889 | A | 9/2018 |
| KR | 10-1833696 | B1 | 2/2018 |
| RU | 2 659 887 | C2 | 7/2018 |
| WO | WO 2007/078273 | A1 | 7/2007 |
| WO | WO 2013/030202 | A1 | 3/2013 |
| WO | WO 2014/182736 | A1 | 11/2014 |
| WO | WO 2014201432 | A1 | 12/2014 |
| WO | WO 2015/042589 | A1 | 3/2015 |
| WO | WO 2015/117702 | A1 | 8/2015 |
| WO | WO 2015/167629 | A1 | 11/2015 |
| WO | WO 2017/103136 | A1 | 6/2017 |
| WO | WO 2017/185051 | A1 | 10/2017 |
| WO | WO 2019/081571 | A1 | 5/2019 |

OTHER PUBLICATIONS

Peyton Jacob III, et al.,, "Recent studies of nicotine metabolism in humans", Pharmacology Biochemistry and Behavior 1988, 30, pp. 249-253.

Lunell, E. et al., "Steady State Nicotine Plasma Levels Following Use of Four Different Types of Swedish Snus Compared with 2-mg Nicorette Chewing Gum: A Crossover Study", Nicotine & Tobacco Research 2005, 7, pp. 397-403.

Rose, J. E. et al., "The Sensory Impact of Nicotine on Noradrenergic and Dopaminergic Neurons of the Nicotine Reward—Addiction Neurocircuitry", Journal of addiction research & therapy 2016, 7, 274, pp. 1-7.

Talavera K. et al., "Nicotine activates the chemosensory cation channel TRPA1", Nature Neuroscience, 2009, 12, pp. 1293-1299.

Ingebrethsen, B. J., "Numerical Simulation of the Effects of Dilution Level, Depth of Inhalation, and Smoke Composition on Nicotine Vapor Deposition During Cigarette Smoking", Inhalation Toxicology 2006, 18, pp. 1071-1076.

Pichelstorfer, L. et al., "Simulation of aerosol dynamics and deposition of combustible and electronic cigarette aerosols in the human respiratory tract", Journal of Aerosol Science, 2016, 99, pp. 125-132.

Seeman, J. I. et al., "On the Deposition of Volatiles and Semivolatiles from Cigarette Smoke Aerosols: Relative Rates of Transfer of Nicotine and Ammonia from Particles to the Gas Phase", Chemical Research in Toxicology 2004, 17, pp. 1020-1037.

Banyasz J.L .; "The hydrophobic aspect of nicotine", CORESTA Meeting, Smoke/Technology, Innsbruck, 1999, ST03, Philip Morris USA, Research Center, Richmond, VA, USA https://www.coresta.org/abstracts/hydrophobic-aspect-nicotine-5588.html.

Japanese Office Action mailed Apr. 23, 2024 in corresponding Japanese Patent Application No. 2021-571928 (with English translation), 5 pages.

International Search Report and Written Opinion issued Aug. 21, 2020 in PCT/EP2020/065498, filed on Jun. 4, 2020, 9 pages.

Combined Russian Office Action and Search Report issued on Sep. 14, 2023 in Russian Patent Application No. 2022100799 (with English translation), 14 pages.

Korean Notice of Allowance issued Dec. 7, 2024, in Korean Patent Application No. 10-2021-7039893 (with English Translation), 3 pages.

Chinese Office Action and Search Report issued Mar. 19, 2025 in corresponding Chinese Patent Application No. 202080038050.2, with English Translation, 23 pages.

Chinese Notice of Allowance issued Aug. 7, 2025 in corresponding Chinese Patent Application No. 202080038050.2, 4 pages.

* cited by examiner

CARTRIDGE COMPRISING NICOTINE AND A WATER-IMMISCIBLE SOLVENT

The invention relates to a cartridge for use in an aerosol-generating system, the cartridge containing a liquid formulation and a second liquid formulation. The invention also relates to aerosol-generating system comprising the cartridge and an aerosol-generating device comprising one or more atomisers configured to generate an aerosol from the first liquid formulation and the second liquid formulation contained in the cartridge.

Aerosol-generating systems for delivering nicotine to a user that comprise a cartridge containing a liquid nicotine formulation and an atomiser configured to generate an inhalable aerosol from the liquid nicotine formulation contained in the cartridge are known. Some known aerosol-generating systems comprise a thermal atomiser such as an electric heater that is configured to heat and vaporise the liquid nicotine formulation in the cartridge to generate an aerosol. Other known aerosol-generating systems comprise a non-thermal atomiser that is configured to generate an aerosol from the liquid nicotine formulation in the cartridge using, for example, impinging jet, ultrasonic or vibrating mesh technologies. Typical liquid nicotine formulations for use in aerosol-generating systems comprise glycerine, propylene glycol and water as solvents.

In such aerosol-generating systems, pulmonary delivery of the inhalable aerosol generated from the liquid nicotine formulation is important for user palatability and satisfaction. Nicotine adsorption through the pulmonary alveoli is rapid and efficient. By contrast, nicotine adsorption in the upper airways is slower and less efficient. Nicotine adsorption in the upper airways may also undesirably be perceived by a user as having a sensorial harshness and induce mouth and throat irritation.

It would be desirable to provide a cartridge containing a liquid formulation for use in an aerosol-generating system that enables generation of an aerosol providing improved nicotine satisfaction to a user compared to cartridges comprising typical liquid nicotine formulations. In particular, it would be desirable to provide a cartridge containing a liquid formulation for use in an aerosol-generating system that enables generation of an aerosol having improved lung deposition characteristics and nicotine retention compared to aerosols generated from cartridges comprising typical liquid nicotine formulations.

The invention relates to a cartridge. The cartridge may be for use in an aerosol-generating system. The cartridge may contain a first liquid formulation. The first liquid formulation may comprise water. The first liquid formulation may comprise one or more water-miscible solvents. The first liquid formulation may comprise at least one of water and one or more water-miscible solvents. The cartridge may contain a second liquid formulation comprising one or more water-immiscible solvents. The one or more water-immiscible solvents may have a water solubility at 20° C. of less than or equal to about 100 mg/ml. At least one of the first liquid formulation and the second liquid formulation may comprise nicotine.

The invention also relates to an aerosol-generating system. The aerosol-generating system may comprise a first liquid formulation. The first liquid formulation may comprise water. The first liquid formulation may comprise one or more water-miscible solvents. The first liquid formulation may comprise at least one of water and one or more water-miscible solvents. The aerosol-generating system may contain a second liquid formulation comprising one or more water-immiscible solvents. The one or more water-immiscible solvents may have a water solubility at 20° C. of less than or equal to about 100 mg/ml. At least one of the first liquid formulation and the second liquid formulation may comprise nicotine. The aerosol-generating system may comprise one or more atomisers. The one or more atomisers may be configured to generate an aerosol from the first liquid formulation and the second liquid formulation.

The aerosol-generating system may comprise a cartridge. The cartridge may contain a first liquid formulation. The first liquid formulation may comprise water. The first liquid formulation may comprise one or more water-miscible solvents. The first liquid formulation may comprise at least one of water and one or more water-miscible solvents. The cartridge may contain a second liquid formulation comprising one or more water-immiscible solvents. The one or more water-immiscible solvents may have a water solubility at 20° C. of less than or equal to about 100 mg/ml. At least one of the first liquid formulation and the second liquid formulation may comprise nicotine. The aerosol-generating system may comprise an aerosol-generating device. The aerosol-generating device may comprise one or more atomisers. The one or more atomisers may be configured to generate an aerosol from the first liquid formulation and the second liquid formulation contained in the cartridge.

According to the invention there is provided a cartridge for use in an aerosol-generating system, the cartridge containing: a first liquid formulation comprising at least one of water and one or more water-miscible solvents; and a second liquid formulation comprising one or more water-immiscible solvents having a water solubility at 20° C. of less than or equal to about 100 mg/ml, wherein at least one of the first liquid formulation and the second liquid formulation comprises nicotine.

According to the invention there is also provided an aerosol-generating system comprising: a first liquid formulation comprising at least one of water and one or more water-miscible solvents; a second liquid formulation comprising one or more water-immiscible solvents having a water solubility at 20° C. of less than or equal to about 100 mg/ml, wherein at least one of the first liquid formulation and the second liquid formulation comprises nicotine; and one or more atomisers configured to generate an aerosol from the first liquid formulation and the second liquid formulation.

According to the invention there is further provided an aerosol-generating system comprising: a cartridge containing a first liquid formulation comprising at least one of water and one or more water-miscible solvents, and a second liquid formulation comprising one or more water-immiscible solvents having a water solubility at 20° C. of less than or equal to about 100 mg/ml, wherein at least one of the first liquid formulation and the second liquid formulation comprises nicotine; and an aerosol-generating device comprising one or more atomisers configured to generate an aerosol from the first liquid formulation and the second liquid formulation contained in the cartridge.

As used herein with reference to the invention, the term "nicotine" describes nicotine, nicotine base or a nicotine salt. In embodiments in which at least one of the first liquid formulation and the second liquid formulation comprises a nicotine base or a nicotine salt, the amounts of nicotine recited herein are the amount of free base nicotine or amount of protonated nicotine, respectively.

As used herein with reference to the invention, the term "water-miscible solvent" describes a compound other than water or an organic acid that is liquid at 20° C. and mixes with water in all proportions to form a homogenous solution.

As used herein with reference to the invention, the term "water-immiscible solvent" describes a compound that is liquid at 20° C. and has a water solubility at 20° C. of less than or equal to about 100 mg/ml.

Unless stated otherwise, water solubility values recited herein are the water solubility measured based on the preliminary test of OECD (1995), Test No. 105: Water Solubility, OECD Guidelines for the Testing of Chemicals, Section 1, OECD Publishing, Paris, https://doi.org/10.1787/9789264069589-en. In a stepwise procedure, increasing volumes of distilled water are added at 20° C. to 0.1 g of the sample (solid substances must be pulverized) in a 10 ml glass-stoppered measuring cylinder. However, when the substance is an acid, the sample is added to the distilled water in the first step. After each addition of an amount of water, the mixture is shaken for 10 minutes and is visually checked for any undissolved parts of the sample. If, after addition of 10 ml of water, the sample or parts of it remain undissolved, the experiment is continued in a 100 ml measuring cylinder. The approximate solubility is given in Table 1 below under that volume of water in which complete dissolution of the sample occurs.

When the solubility is low, a long time may be required to dissolve a substance and at least 24 hours should be allowed. If, after 24 hours, the substance is still not dissolved, the measuring cylinder is placed for at 40° C. in an ultrasound bath for 15 minutes and another 24 hours allowed (up to a maximum of 96 hours). If the substance is still not dissolved, the solubility is considered to be below the limit value or not soluble.

TABLE 1

| | ml of water in which 0.1 g of sample is soluble | | | | | | |
|---|---|---|---|---|---|---|---|
| | 0.1 | 0.5 | 1 | 2 | 10 | 100 | >100 |
| Approximate solubility (mg/ml) | >1000 | 1000 to 200 | 200 to 100 | 100 to 50 | 50 to 10 | 10 to 1 | <1 |

The first liquid formulation and the second liquid formulation are distinct liquid formulations.

The first liquid formulation and the second liquid formulation are physically separate liquid formulations.

Inclusion of a combination of a first liquid formulation comprising at least one of water and one or more water-miscible solvents and a second liquid formulation comprising one or more water-immiscible solvents, wherein at least one of the first liquid formulation and the second liquid formulation comprises nicotine, in the cartridge and aerosol-generating system according to the invention advantageously enables generation of an inhalable aerosol providing improved nicotine satisfaction to a user compared to aerosols generated from typical liquid nicotine formulations. In particular, inclusion of a first liquid formulation comprising at least one of water and one or more water-miscible solvents and a second liquid formulation comprising one or more water-immiscible solvents, wherein at least one of the first liquid formulation and the second liquid formulation comprises nicotine, in the cartridge and aerosol-generating system according to the invention advantageously enables generation of an inhalable aerosol having improved lung deposition characteristics and nicotine retention compared to aerosols generated from typical liquid nicotine formulations.

Inclusion of a combination of a first liquid formulation comprising at least one of water and one or more water-miscible solvents and a second liquid formulation comprising one or more water-immiscible solvents, wherein at least one of the first liquid formulation and the second liquid formulation comprises nicotine, in the cartridge and aerosol-generating system according to the invention may enable generation of an inhalable aerosol comprising dual-phase particles or droplets comprising an aqueous or water-miscible phase and a water-immiscible phase. This may advantageously reduce nicotine adsorption in the upper airways and enhances pulmonary nicotine delivery and retention. Without wishing to be bound by theory, the improvement in pulmonary nicotine delivery and retention is believed to be due to coating or enveloping of the aqueous or water-miscible phase by the water immiscible phase. This is believed to reduce nicotine evaporation and adsorption in the upper airways.

Inclusion of a combination of a first liquid formulation comprising at least one of water and one or more water-miscible solvents and a second liquid formulation comprising one or more water-immiscible solvents, wherein at least one of the first liquid formulation and the second liquid formulation comprises nicotine, in the cartridge and aerosol-generating system according to the invention may advantageously prevent or reduce separation or partitioning of water-miscible and water immiscible components of the liquid formulations.

Inclusion of a combination of a first liquid formulation comprising at least one of water and one or more water-miscible solvents and a second liquid formulation comprising one or more water-immiscible solvents, wherein at least one of the first liquid formulation and the second liquid formulation comprises nicotine, in the cartridge and aerosol-generating system according to the invention may advantageously avoid the need for inclusion of an emulsifier in the liquid formulations.

The first liquid formulation comprises at least one of water and one or more water-miscible solvents. That is, the first liquid formulation comprises water or one or more miscible solvents or both water and one or more miscible solvents.

Unless stated otherwise, percentages by weight of components of the first liquid formulation recited herein are based on the total weight of the first liquid formulation.

The first liquid formulation may have a total water and water-miscible solvent content of greater than or equal to about 65 percent by weight or greater than or equal to about 70 percent by weight.

Preferably, the first liquid formulation has a total water and water-miscible solvent content of greater than or equal to about 75 percent by weight. More preferably, the first liquid formulation has a total water and water-miscible solvent content of greater than or equal to 80 percent by weight. For example, the first liquid formulation may have a total water and water-miscible solvent content of greater than or equal to about 85 percent by weight or greater than or equal to about 90 percent by weight.

In embodiments in which first liquid formulation comprises water, the water may advantageously help to dissolve and stabilise polar components and ionic components of the first liquid formulation.

The first liquid formulation may have a water content of greater than or equal to about 10 percent by weight or greater than or equal to about 15 percent by weight.

Preferably, the first liquid formulation has a water content of greater than or equal to about 20 percent by weight. More preferably, the first liquid formulation has a water-content of greater than or equal to about 25 percent by weight. For example, the first liquid formulation may have a water content of greater than or equal to about 30 percent by weight.

The first liquid formulation may have a water content of less than or equal to about 75 percent by weight or less than or equal to about 70 percent by weight.

Preferably, the first liquid formulation has a water content of less than or equal to about 65 percent by weight. More preferably, the first liquid formulation has a water content of less than or equal to about 60 percent by weight. For example, the first liquid formulation may have a water content of less than or equal to about 55 percent by weight or less than or equal to about 50 percent by weight.

The first liquid formulation may have a water content of between about 10 percent by weight and about 75 percent by weight. For example, the first liquid formulation may have a water content of between about 10 percent by weight and about 70 percent by weight, between about 10 percent by weight and about 65 percent by weight, between about 10 percent by weight and about 60 percent by weight, between about 10 percent by weight and about 55 percent by weight or between about 10 percent by weight and about 50 percent by weight.

The first liquid formulation may have a water content of between about 15 percent by weight and about 75 percent by weight. For example, the first liquid formulation may have a water content of between about 15 percent by weight and about 70 percent by weight, between about 15 percent by weight and about 65 percent by weight, between about 15 percent by weight and about 60 percent by weight, between about 15 percent by weight and about 55 percent by weight or between about 15 percent by weight and about 50 percent by weight.

The first liquid formulation may have a water content of between about 20 percent by weight and about 75 percent by weight or between about 20 percent by weight and about 70 percent by weight. Preferably, the first liquid formulation has a water content of between about 20 percent by weight and about 65 percent by weight. For example, the first liquid formulation may have a water content of between about 20 percent by weight and about 60 percent by weight, between about 20 percent by weight and about 55 percent by weight or between about 20 percent by weight and about 50 percent by weight.

The first liquid formulation may have a water content of between about 25 percent by weight and about 75 percent by weight or between about 25 percent by weight and about 70 percent by weight. More preferably, the first liquid formulation has a water content of between about 25 percent by weight and about 65 percent by weight. For example, the first liquid formulation may have a water content of between about 25 percent by weight and about 60 percent by weight, between about 25 percent by weight and about 55 percent by weight or between about 25 percent by weight and about 50 percent by weight.

The first liquid formulation may have a water content of between about 30 percent by weight and about 75 percent by weight. For example, the first liquid formulation may have a water content of between about 30 percent by weight and about 70 percent by weight, between about 30 percent by weight and about 65 percent by weight, between about 30 percent by weight and about 60 percent by weight, between about 30 percent by weight and about 55 percent by weight or between about 30 percent by weight and about 50 percent by weight.

In embodiments in which the first liquid formulation comprises one or more water-miscible solvents, the one or more water-miscible solvents may advantageously help to dissolve and stabilise polar components and ionic components of the first liquid formulation.

The first liquid formulation may have a water-miscible solvent content of greater than or equal to about 20 percent by weight or greater than or equal to about 25 percent by weight.

Preferably, the first liquid formulation has a water-miscible solvent content of greater than or equal to about 30 percent by weight. More preferably, the first liquid formulation has a water-miscible solvent content of greater than or equal to about 35 percent by weight. For example, the first liquid formulation may have a water-miscible solvent content of greater than or equal to about 40 percent by weight or greater than or equal to about 45 percent by weight.

The first liquid formulation may have a water-miscible solvent content of less than or equal to about 90 percent by weight or less than or equal to about 85 percent by weight.

Preferably, the first liquid formulation has a water-miscible solvent content of less than or equal to about 80 percent by weight. More preferably, the first liquid formulation has a water-miscible solvent content of less than or equal to about 75 percent by weight. For example, the first liquid formulation may have a water-miscible solvent content of less than or equal to about 70 percent by weight or less than or equal to about 65 percent by weight.

The first liquid formulation may have a water-miscible solvent content of between about 20 percent by weight and about 90 percent by weight. For example, the first liquid formulation may have a water-miscible solvent content of between about 20 percent by weight and about 85 percent by weight, between about 20 percent by weight and about 80 percent by weight, between about 20 percent by weight and about 75 percent by weight, between about 20 percent by weight and about 70 percent by weight or between about 20 percent by weight and about 65 percent by weight.

The first liquid formulation may have a water-miscible solvent content of between about 25 percent by weight and about 90 percent by weight. For example, the first liquid formulation may have a water-miscible solvent content of between about 25 percent by weight and about 85 percent by weight, between about 25 percent by weight and about 80 percent by weight, between about 25 percent by weight and about 75 percent by weight, between about 25 percent by weight and about 70 percent by weight or between about 25 percent by weight and about 65 percent by weight.

Preferably, the first liquid formulation has a water-miscible solvent content of between about 30 percent by weight and about 90 percent by weight. For example, the first liquid formulation may have a water-miscible solvent content of between about 30 percent by weight and about 85 percent by weight, between about 30 percent by weight and about 80 percent by weight, between about 30 percent by weight and about 75 percent by weight, between about 30 percent by weight and about 70 percent by weight or between about 30 percent by weight and about 65 percent by weight.

More preferably, the first liquid formulation has a water-miscible solvent content of between about 35 percent by weight and about 90 percent by weight. For example, the first liquid formulation may have a water-miscible solvent content of between about 35 percent by weight and about 85 percent by weight, between about 35 percent by weight and about 80 percent by weight, between about 35 percent by weight and about 75 percent by weight, between about 35 percent by weight and about 70 percent by weight or between about 35 percent by weight and about 65 percent by weight.

The first liquid formulation may have a water-miscible solvent content of between about 40 percent by weight and about 90 percent by weight. For example, the first liquid formulation may have a water-miscible solvent content of between about 40 percent by weight and about 85 percent by weight, between about 40 percent by weight and about 80 percent by weight, between about 40 percent by weight and about 75 percent by weight, between about 40 percent by weight and about 70 percent by weight or between about 40 percent by weight and about 65 percent by weight.

The first liquid formulation may have a water-miscible solvent content of between about 45 percent by weight and about 90 percent by weight. For example, the first liquid formulation may have a water-miscible solvent content of between about 45 percent by weight and about 85 percent by weight, between about 45 percent by weight and about 80 percent by weight, between about 45 percent by weight and about 75 percent by weight, between about 45 percent by weight and about 70 percent by weight or between about 45 percent by weight and about 65 percent by weight.

Preferably, the one or more water-miscible solvents are one or more water-miscible polyhydric alcohols.

As used herein with reference to the invention, the term "water-miscible polyhydric alcohol" describes a polyhydric alcohol that is liquid at 20° C. and mixes with water in all proportions to form a homogenous solution.

According to a preferred embodiment of the invention there is provided a cartridge for use in an aerosol-generating system, the cartridge containing: a first liquid formulation comprising at least one of water and one or more water-miscible polyhydric alcohols; and a second liquid formulation comprising one or more water-immiscible solvents having a water solubility at 20° C. of less than or equal to about 100 mg/ml, wherein at least one of the first liquid formulation and the second liquid formulation comprises nicotine.

According to a preferred embodiment of the invention there is also provided an aerosol-generating system comprising: a first liquid formulation comprising at least one of water and one or more water-miscible polyhydric alcohols; a second liquid formulation comprising one or more water-immiscible solvents having a water solubility at 20° C. of less than or equal to about 100 mg/ml, wherein at least one of the first liquid formulation and the second liquid formulation comprises nicotine; and one or more atomisers configured to generate an aerosol from the first liquid formulation and the second liquid formulation.

According to a preferred embodiment of the invention there is further provided an aerosol-generating system comprising: a cartridge containing a first liquid formulation comprising at least one of water and one or more water-miscible polyhydric alcohols, and a second liquid formulation comprising one or more water-immiscible solvents having a water solubility at 20° C. of less than or equal to about 100 mg/ml, wherein at least one of the first liquid formulation and the second liquid formulation comprises nicotine; and an aerosol-generating device comprising one or more atomisers configured to generate an aerosol from the first liquid formulation and the second liquid formulation contained in the cartridge.

The first liquid formulation may have a water-miscible polyhydric alcohol content of greater than or equal to about 20 percent by weight or greater than or equal to about 25 percent by weight.

Preferably, the first liquid formulation has a water-miscible polyhydric alcohol content of greater than or equal to about 30 percent by weight. More preferably, the first liquid formulation has a water-miscible polyhydric alcohol content of greater than or equal to about 35 percent by weight. For example, the first liquid formulation may have a water-miscible polyhydric alcohol content of greater than or equal to about 40 percent by weight or greater than or equal to about 45 percent by weight.

The first liquid formulation may have a water-miscible polyhydric alcohol content of less than or equal to about 90 percent by weight or less than or equal to about 85 percent by weight.

Preferably, the first liquid formulation has a water-miscible polyhydric alcohol content of less than or equal to about 80 percent by weight. More preferably, the first liquid formulation has a water-miscible polyhydric alcohol content of less than or equal to about 75 percent by weight. For example, the first liquid formulation may have a water-miscible polyhydric alcohol content of less than or equal to about 70 percent by weight or less than or equal to about 65 percent by weight.

The first liquid formulation may have a water-miscible polyhydric alcohol content of between about 20 percent by weight and about 90 percent by weight. For example, the first liquid formulation may have a water-miscible polyhydric alcohol content of between about 20 percent by weight and about 85 percent by weight, between about 20 percent by weight and about 80 percent by weight, between about 20 percent by weight and about 75 percent by weight, between about 20 percent by weight and about 70 percent by weight or between about 20 percent by weight and about 65 percent by weight.

The first liquid formulation may have a water-miscible polyhydric alcohol content of between about 25 percent by weight and about 90 percent by weight. For example, the first liquid formulation may have a water-miscible polyhydric alcohol content of between about 25 percent by weight and about 85 percent by weight, between about 25 percent by weight and about 80 percent by weight, between about 25 percent by weight and about 75 percent by weight, between about 25 percent by weight and about 70 percent by weight or between about 25 percent by weight and about 65 percent by weight.

Preferably, the first liquid formulation has a water-miscible polyhydric alcohol content of between about 30 percent by weight and about 90 percent by weight. For example, the first liquid formulation may have a water-miscible polyhydric alcohol content of between about 30 percent by weight and about 85 percent by weight, between about 30 percent by weight and about 80 percent by weight, between about 30 percent by weight and about 75 percent by weight, between about 30 percent by weight and about 70 percent by weight or between about 30 percent by weight and about 65 percent by weight.

More preferably, the first liquid formulation has a water-miscible polyhydric alcohol content of between about 35 percent by weight and about 90 percent by weight. For example, the first liquid formulation may have a water-miscible polyhydric alcohol content of between about 35 percent by weight and about 85 percent by weight, between about 35 percent by weight and about 80 percent by weight, between about 35 percent by weight and about 75 percent by weight, between about 35 percent by weight and about 70 percent by weight or between about 35 percent by weight and about 65 percent by weight.

The first liquid formulation may have a water-miscible polyhydric alcohol content of between about 40 percent by weight and about 90 percent by weight. For example, the first liquid formulation comprises one or more water-miscible polyhydric alcohols, the first liquid formulation may have a water-miscible polyhydric alcohol content of between about 40 percent by weight and about 85 percent by weight, between about 40 percent by weight and about 80 percent by weight, between about 40 percent by weight and about 75 percent by weight, between about 40 percent by weight and about 70 percent by weight or between about 40 percent by weight and about 65 percent by weight.

The first liquid formulation may have a water-miscible polyhydric alcohol content of between about 45 percent by weight and about 90 percent by weight. For example, the first liquid formulation may have a water-miscible polyhydric alcohol content of between about 45 percent by weight and about 85 percent by weight, between about 45 percent by weight and about 80 percent by weight, between about 45 percent by weight and about 75 percent by weight, between about 45 percent by weight and about 70 percent by weight or between about 45 percent by weight and about 65 percent by weight.

Preferably, the one or more water-miscible polyhydric alcohols are selected from the group consisting of 1,3-butanediol, glycerine, propylene glycol, and triethylene glycol.

More preferably, the one or more water-miscible polyhydric alcohols are selected from the group consisting of glycerine and propylene glycol.

Most preferably, the one or more water-miscible polyhydric alcohols are selected from the group consisting of vegetable glycerine and propylene glycol.

According to a preferred embodiment of the invention there is provided a cartridge for use in an aerosol-generating system, the cartridge containing: a first liquid formulation comprising at least one of water and one or more water-miscible polyhydric alcohols selected from the group consisting of glycerine and propylene glycol; and a second liquid formulation comprising one or more water-immiscible solvents having a water solubility at 20° C. of less than or equal to about 100 mg/ml, wherein at least one of the first liquid formulation and the second liquid formulation comprises nicotine.

According to a preferred embodiment of the invention there is also provided an aerosol-generating system comprising: a first liquid formulation comprising at least one of water and one or more water-miscible polyhydric alcohols selected from the group consisting of glycerine and propylene glycol; a second liquid formulation comprising one or more water-immiscible solvents having a water solubility at 20° C. of less than or equal to about 100 mg/ml, wherein at least one of the first liquid formulation and the second liquid formulation comprises nicotine; and one or more atomisers configured to generate an aerosol from the first liquid formulation and the second liquid formulation.

According to a preferred embodiment of the invention there is further provided an aerosol-generating system comprising: a cartridge containing a first liquid formulation comprising at least one of water and one or more water-miscible polyhydric alcohols selected from the group consisting of glycerine and propylene glycol, and a second liquid formulation comprising one or more water-immiscible solvents having a water solubility at 20° C. of less than or equal to about 100 mg/ml, wherein at least one of the first liquid formulation and the second liquid formulation comprises nicotine; and an aerosol-generating device comprising one or more atomisers configured to generate an aerosol from the first liquid formulation and the second liquid formulation contained in the cartridge.

The first liquid formulation may have a combined glycerine and propylene glycol content of greater than or equal to about 20 percent by weight or greater than or equal to about 25 percent by weight.

Preferably, the first liquid formulation has a combined glycerine and propylene glycol content of greater than or equal to about 30 percent by weight. More preferably, the first liquid formulation has a combined glycerine and propylene glycol content of greater than or equal to about 35 percent by weight. For example, the first liquid formulation may have a combined glycerine and propylene glycol content of greater than or equal to about 40 percent by weight or greater than or equal to about 45 percent by weight.

The first liquid formulation may have a combined glycerine and propylene glycol content of less than or equal to about 90 percent by weight or less than or equal to about 85 percent by weight.

Preferably, the first liquid formulation has a combined glycerine and propylene glycol content of less than or equal to about 80 percent by weight. More preferably, the first liquid formulation has a combined glycerine and propylene glycol content of less than or equal to about 75 percent by weight. For example, the first liquid formulation may have a combined glycerine and propylene glycol content of less than or equal to about 70 percent by weight or less than or equal to about 65 percent by weight.

The first liquid formulation may have a combined glycerine and propylene glycol content of between about 20 percent by weight and about 90 percent by weight. For example, the first liquid formulation may have a combined glycerine and propylene glycol content of between about 20 percent by weight and about 85 percent by weight, between about 20 percent by weight and about 80 percent by weight, between about 20 percent by weight and about 75 percent by weight, between about 20 percent by weight and about 70 percent by weight or between about 20 percent by weight and about 65 percent by weight.

The first liquid formulation may have a combined glycerine and propylene glycol content of between about 25 percent by weight and about 90 percent by weight. For example, the first liquid formulation may have a combined glycerine and propylene glycol content of between about 25 percent by weight and about 85 percent by weight, between about 25 percent by weight and about 80 percent by weight, between about 25 percent by weight and about 75 percent by weight, between about 25 percent by weight and about 70 percent by weight or between about 25 percent by weight and about 65 percent by weight.

Preferably, the first liquid formulation has a combined glycerine and propylene glycol content of between about 30 percent by weight and about 90 percent by weight. For example, the first liquid formulation may have a combined glycerine and propylene glycol content of between about 30 percent by weight and about 85 percent by weight, between about 30 percent by weight and about 80 percent by weight, between about 30 percent by weight and about 75 percent by weight, between about 30 percent by weight and about 70 percent by weight or between about 30 percent by weight and about 65 percent by weight.

More preferably, the first liquid formulation has a combined glycerine and propylene glycol content of between about 35 percent by weight and about 90 percent by weight. For example, the first liquid formulation may have a combined glycerine and propylene glycol content of between about 35 percent by weight and about 85 percent by weight, between about 35 percent by weight and about 80 percent by weight, between about 35 percent by weight and about 75 percent by weight, between about 35 percent by weight and about 70 percent by weight or between about 35 percent by weight and about 65 percent by weight.

The first liquid formulation may have a combined glycerine and propylene glycol content of between about 40 percent by weight and about 90 percent by weight. For example, the first liquid formulation may have a combined glycerine and propylene glycol content of between about 40 percent by weight and about 85 percent by weight, between about 40 percent by weight and about 80 percent by weight, between about 40 percent by weight and about 75 percent by weight, between about 40 percent by weight and about 70 percent by weight or between about 40 percent by weight and about 65 percent by weight.

The first liquid formulation may have a combined glycerine and propylene glycol content of between about 45 percent by weight and about 90 percent by weight. For example, the first liquid formulation may have a combined glycerine and propylene glycol content of between about 45 percent by weight and about 85 percent by weight, between about 45 percent by weight and about 80 percent by weight, between about 45 percent by weight and about 75 percent by weight, between about 45 percent by weight and about 70 percent by weight or between about 45 percent by weight and about 65 percent by weight.

Preferably, the first liquid formulation comprises water and one or more water-miscible solvents.

According to a preferred embodiment of the invention there is provided a cartridge for use in an aerosol-generating system, the cartridge containing: a first liquid formulation comprising at water and one or more water-miscible miscible solvents; and a second liquid formulation comprising one or more water-immiscible solvents having a water solubility at 20° C. of less than or equal to about 100 mg/ml, wherein at least one of the first liquid formulation and the second liquid formulation comprises nicotine.

According to a preferred embodiment of the invention there is also provided an aerosol-generating system comprising: a first liquid formulation comprising water and one or more water-miscible miscible solvents; a second liquid formulation comprising one or more water-immiscible solvents having a water solubility at 20° C. of less than or equal to about 100 mg/ml, wherein at least one of the first liquid formulation and the second liquid formulation comprises nicotine; and one or more atomisers configured to generate an aerosol from the first liquid formulation and the second liquid formulation.

According to a preferred embodiment of the invention there is further provided an aerosol-generating system comprising: a cartridge containing a first liquid formulation comprising water and one or more water-miscible miscible solvents, and a second liquid formulation comprising one or more water-immiscible solvents having a water solubility at 20° C. of less than or equal to about 100 mg/ml, wherein at least one of the first liquid formulation and the second liquid formulation comprises nicotine; and an aerosol-generating device comprising one or more atomisers configured to generate an aerosol from the first liquid formulation and the second liquid formulation contained in the cartridge.

The first liquid formulation may have a combined water and water-miscible solvent content of greater than or equal to about 65 percent by weight or greater than or equal to about 70 percent by weight.

Preferably, the first liquid formulation has a combined water and water-miscible solvent content of greater than or equal to about 75 percent by weight. More preferably, the first liquid formulation has a combined water and water-miscible solvent content of greater than or equal to 80 percent by weight. For example, the first liquid formulation may have a combined water and water-miscible solvent content of greater than or equal to about 85 percent by weight or greater than or equal to about 90 percent by weight.

More preferably, the first liquid formulation comprises water and one or more water-miscible polyhydric alcohols.

According to a more preferred embodiment of the invention there is provided a cartridge for use in an aerosol-generating system, the cartridge containing: a first liquid formulation comprising at water and one or more water-miscible miscible polyhydric alcohols; and a second liquid formulation comprising one or more water-immiscible solvents having a water solubility at 20° C. of less than or equal to about 100 mg/ml, wherein at least one of the first liquid formulation and the second liquid formulation comprises nicotine.

According to a more preferred embodiment of the invention there is also provided an aerosol-generating system comprising: a first liquid formulation comprising water and one or more water-miscible miscible polyhydric alcohols; a second liquid formulation comprising one or more water-immiscible solvents having a water solubility at 20° C. of less than or equal to about 100 mg/ml, wherein at least one of the first liquid formulation and the second liquid formulation comprises nicotine; and one or more atomisers configured to generate an aerosol from the first liquid formulation and the second liquid formulation.

According to a more preferred embodiment of the invention there is further provided an aerosol-generating system comprising: a cartridge containing a first liquid formulation comprising water and one or more water-miscible miscible polyhydric alcohols, and a second liquid formulation comprising one or more water-immiscible solvents having a water solubility at 20° C. of less than or equal to about 100 mg/ml, wherein at least one of the first liquid formulation and the second liquid formulation comprises nicotine; and an aerosol-generating device comprising one or more atomisers configured to generate an aerosol from the first liquid formulation and the second liquid formulation contained in the cartridge.

The first liquid formulation may have a combined water and water-miscible polyhydric alcohol content of greater than or equal to about 65 percent by weight or greater than or equal to about 70 percent by weight.

Preferably, the first liquid formulation has a combined water and water-miscible polyhydric alcohol content of greater than or equal to about 75 percent by weight. More preferably, the first liquid formulation has a combined water and water-miscible polyhydric alcohol content of greater than or equal to 80 percent by weight. For example, the first liquid formulation may have a combined water and water-miscible polyhydric alcohol content of greater than or equal to about 85 percent by weight or greater than or equal to about 90 percent by weight.

Preferably, the ratio of the weight percent water-miscible polyhydric alcohol content to the weight percent water content of the first liquid formulation is greater than or equal to about 1. For example, the ratio of the weight percent water-miscible polyhydric alcohol content to the weight percent water content of the first liquid formulation may be greater than or equal to about 1.1, greater than or equal to about 1.2, greater than or equal to about 1.3 or greater than or equal to about 1.4.

Most preferably, the first liquid formulation comprises water and one or more water-miscible polyhydric alcohols selected from the group consisting of glycerine and propylene glycol.

According to a most preferred embodiment of the invention there is provided a cartridge for use in an aerosol-generating system, the cartridge containing: a first liquid formulation comprising at water and one or more water-miscible miscible polyhydric alcohols selected from the group consisting of glycerine and propylene glycol; and a second liquid formulation comprising one or more water-immiscible solvents having a water solubility at 20° C. of less than or equal to about 100 mg/ml, wherein at least one of the first liquid formulation and the second liquid formulation comprises nicotine.

According to a most preferred embodiment of the invention there is also provided an aerosol-generating system comprising: a first liquid formulation comprising water and one or more water-miscible miscible polyhydric alcohols selected from the group consisting of glycerine and propylene glycol; a second liquid formulation comprising one or more water-immiscible solvents having a water solubility at 20° C. of less than or equal to about 100 mg/ml, wherein at least one of the first liquid formulation and the second liquid formulation comprises nicotine; and one or more atomisers configured to generate an aerosol from the first liquid formulation and the second liquid formulation.

According to a most preferred embodiment of the invention there is further provided an aerosol-generating system comprising: a cartridge containing a first liquid formulation comprising water and one or more water-miscible miscible polyhydric alcohols selected from the group consisting of glycerine and propylene glycol, and a second liquid formulation comprising one or more water-immiscible solvents having a water solubility at 20° C. of less than or equal to about 100 mg/ml, wherein at least one of the first liquid formulation and the second liquid formulation comprises nicotine; and an aerosol-generating device comprising one or more atomisers configured to generate an aerosol from the first liquid formulation and the second liquid formulation contained in the cartridge.

The first liquid formulation may have a combined water, glycerine and propylene glycol content of greater than or equal to about 65 percent by weight or greater than or equal to about 70 percent by weight.

Preferably, the first liquid formulation has a combined water, glycerine and propylene glycol content of greater than or equal to about 75 percent by weight. More preferably, the first liquid formulation has a combined water, glycerine and propylene glycol content of greater than or equal to 80 percent by weight. For example, the first liquid formulation may have a combined water, glycerine and propylene glycol content of greater than or equal to about 85 percent by weight or greater than or equal to about 90 percent by weight.

Preferably, the ratio of the weight percent combined glycerine and propylene glycol content to the weight percent water content of the first liquid formulation is greater than or equal to about 1. For example, the ratio of the weight percent combined glycerine and propylene glycol content to the weight percent water content of the first liquid formulation may be greater than or equal to about 1.1, greater than or equal to about 1.2, greater than or equal to about 1.3 or greater than or equal to about 1.4.

The first liquid formulation may comprise nicotine.

The first liquid formulation may comprise natural nicotine or synthetic nicotine.

In embodiments in which the first liquid formulation comprises nicotine, preferably the first liquid formulation has a nicotine content of greater than or equal to about 0.5 percent by weight. More preferably the first liquid formulation has a nicotine content of greater than or equal to about 1 percent by weight.

The first liquid formulation may have a nicotine content of greater than or equal to about 1.5 percent by weight or greater than or equal to about 2 percent by weight.

The first liquid formulation may have a nicotine content of less than or equal to about 10 percent by weight or less than or equal to about 8 percent by weight.

Preferably, the first liquid formulation has a nicotine content of less than or equal to about 6 percent by weight. More preferably, the first liquid formulation has a nicotine content of less than or equal to about 4 percent by weight.

Preferably, the first liquid formulation has a nicotine content of between about 0.5 percent by weight and about 10 percent by weight. For example, the first liquid formulation may have a nicotine content of between about 0.5 percent by weight and about 8 percent by weight, between about 0.5 percent by weight and about 6 percent by weight or between about 0.5 percent by weight and about 4 percent by weight.

More preferably, the first liquid formulation has a nicotine content of between about 1 percent by weight and about 10 percent by weight. For example, the first liquid formulation may have a nicotine content of between about 1 percent by weight and about 8 percent by weight, between about 1 percent by weight and about 6 percent by weight or between about 1 percent by weight and about 4 percent by weight.

The first liquid formulation may have a nicotine content of between about 1.5 percent by weight and about 10 percent by weight. For example, the first liquid formulation may have a nicotine content of between about 1.5 percent by weight and about 8 percent by weight, between about 1.5 percent by weight and about 6 percent by weight or between about 1.5 percent by weight and about 4 percent by weight.

The first liquid formulation may have a nicotine content of between about 2 percent by weight and about 10 percent by weight. For example, the first liquid formulation may have a nicotine content of between about 2 percent by weight and about 8 percent by weight, between about 2 percent by weight and about 6 percent by weight or between about 2 percent by weight and about 4 percent by weight.

Preferably, the first liquid formulation comprises one or more water-soluble organic acids.

As used herein with reference to the invention, the term "water-soluble organic acid" describes an organic acid having a water solubility at 20° C. of greater than or equal to about 500 mg/ml.

In embodiments in which the first liquid formulation comprises nicotine, the one or more water-soluble organic acids may advantageously bind nicotine in the first liquid formulation through formation of one or nicotine salts. The one or more nicotine salts may advantageously be dissolved and stabilised in the at least one of water and one or more water-miscible solvents. This may advantageously reduce nicotine adsorption in the upper airways and enhance pulmonary nicotine delivery and retention as discussed above.

More preferably, the first liquid formulation comprises one or more water-soluble carboxylic acids.

Suitable water-soluble carboxylic acids include, but are not limited to, acetic acid, benzoic acid, citric acid, lactic acid, levulinic acid, malic acid, malonic acid and pyruvic acid.

Most preferably, the first liquid formulation comprises lactic acid.

Preferably, the first liquid formulation has a water-soluble organic acid content of greater than or equal to about 1.5 percent by weight. More preferably, the first liquid formulation has a water-soluble organic acid content of greater than or equal to about 2 percent by weight.

Preferably, the first liquid formulation has a water-soluble organic acid content of less than or equal to about 7 percent by weight. More preferably, the first liquid formulation has a water-soluble organic acid content of less than or equal to about 5 percent by weight.

Preferably, the first liquid formulation has a water-soluble organic acid content of between about 1.5 percent by weight and about 7 percent by weight. For example, the first liquid formulation may have a water-soluble organic acid content of between about 1.5 percent by weight and about 5 percent by weight.

More preferably, the first liquid formulation has a water-soluble organic acid content of between about 2 percent by weight and about 7 percent by weight. For example, the first liquid formulation may have a water-soluble organic acid content of between about 2 percent by weight and about 5 percent by weight.

The first liquid formulation may comprise one or more flavourants.

The first liquid formulation may comprise one or more polar flavourants.

The first liquid formulation may comprise one or more hydrophilic flavourants.

The first liquid formulation may comprise one or more polar flavourants and one or more hydrophilic flavourants.

Suitable flavourants for inclusion in the first liquid formulation include, but are not limited to, guaiacol, 4-hydroxy-2,5-dimethylfuran-3(2H)-one, isovaleric acid, maltol, phenylacetic acid, valeric acid and vanillin.

The first liquid formulation may a flavourant content of less than or equal to about 5 percent by weight. For example, the first liquid formulation may have a flavourant content of less than or equal to about 4 percent by weight or less than or equal to about 3 percent by weight.

The second liquid formulation comprises one or more water-immiscible solvents.

The water-immiscible solvents may advantageously help to dissolve and stabilise non-polar components of the second liquid formulation.

The water-immiscible solvents may reduce the hygroscopicity of an aerosol generated from the first liquid nicotine formulation and the second liquid formulation. This may advantageously reduce or prevent increases in the particle or droplet size of the aerosol when inhaled by a user as a result of adsorption of water in the respiratory tract.

Unless stated otherwise, percentages by weight of components of the second liquid formulation recited herein are based on the total weight of the second liquid formulation.

The second liquid formulation may have a water-immiscible solvent content of greater than or equal to about 55 percent by weight, greater than or equal to about 60 percent by weight or greater than about 65 percent by weight.

Preferably, the second liquid formulation has a water-immiscible solvent content of greater than or equal to about 70 percent by weight. More preferably, the second liquid formulation has a water-immiscible solvent content of greater than or equal to about 75 percent by weight. For example, the second liquid formulation may have a water-immiscible solvent content of greater than or equal to about 80 percent by weight.

The second liquid formulation may have a water-immiscible solvent content of less than or equal to about 95 percent by weight or less than or equal to about 92 percent by weight. For example, the second liquid formulation may have a water-immiscible solvent content of less than or equal to about 90 percent by weight The second liquid formulation may have a water-immiscible solvent content of between about 55 percent by weight and about 95 percent by weight. For example, the second liquid formulation may have a water-immiscible solvent content of between about 55 percent by weight and about 92 percent by weight or between about 55 percent by weight and about 90 percent by weight.

The second liquid formulation may have a water-immiscible solvent content of between about 60 percent by weight and about 95 percent by weight. For example, the second liquid formulation may have a water-immiscible solvent content of between about 60 percent by weight and about 92 percent by weight or between about 60 percent by weight and about 90 percent by weight.

The second liquid formulation may have a water-immiscible solvent content of between about 65 percent by weight and about 95 percent by weight. For example, the second liquid formulation may have a water-immiscible solvent content of between about 65 percent by weight and about 92 percent by weight or between about 65 percent by weight and about 90 percent by weight.

Preferably, the second liquid formulation has a water-immiscible solvent content of between about 70 percent by weight and about 95 percent by weight. For example, the second liquid formulation may have a water-immiscible solvent content of between about 70 percent by weight and about 92 percent by weight or between about 70 percent by weight and about 90 percent by weight.

More preferably, the second liquid formulation may have a water-immiscible solvent content of between about 75 percent by weight and about 95 percent by weight. For example, the second liquid formulation may have a water-immiscible solvent content of between about 75 percent by weight and about 92 percent by weight or between about 75 percent by weight and about 90 percent by weight.

The second liquid formulation may have a water-immiscible solvent content of between about 80 percent by weight and about 95 percent by weight. For example, the second liquid formulation may have a water-immiscible solvent content of between about 80 percent by weight and about 92 percent by weight or between about 80 percent by weight and about 90 percent by weight.

Preferably, the second liquid formulation comprises one or more water-immiscible solvents selected from the group consisting of polysorbate 80, triacetin, triethyl citrate, oleic acid and MIGLYOL® (mixture of decanoyl- and octanoyl glycerides).

The one or more water-immiscible solvents may comprise one or more partially water-soluble solvents.

As used herein with reference to the invention, the term "partially water-soluble solvent" describes a compound that is liquid at 20° C. and has a water solubility at 20° C. of between about 20 mg/ml and about 100 mg/ml.

The second liquid formulation may have a partially water-soluble solvent content of greater than or equal to about 55 percent by weight, greater than or equal to about 60 percent by weight or greater than or equal to about 65 percent by weight. For example, the second liquid formulation may have a partially water-soluble solvent content of greater than or equal to about 70 percent by weight, greater than or equal to about 75 percent by weight or greater than or equal to about 80 percent by weight.

The second liquid formulation may have a partially water-soluble solvent content of less than or equal to about 95 percent by weight, less than or equal to about 92 percent by weight or less than or equal to about 90 percent by weight.

The second liquid formulation may have a partially water-soluble solvent content of between about 55 percent by weight and about 95 percent by weight. For example, the second liquid formulation may have a partially water-soluble solvent content of between about 55 percent by weight and about 92 percent by weight or between about 55 percent by weight and about 90 percent by weight.

The second liquid formulation may have a partially water-soluble solvent content of between about 60 percent by weight and about 95 percent by weight. For example, the second liquid formulation may have a partially water-soluble solvent content of between about 60 percent by weight and about 92 percent by weight or between about 60 percent by weight and about 90 percent by weight.

The second liquid formulation may have a partially water-soluble solvent content of between about 65 percent by weight and about 95 percent by weight. For example, the second liquid formulation may have a partially water-soluble solvent content of between about 65 percent by weight and about 92 percent by weight or between about 65 percent by weight and about 90 percent by weight.

The second liquid formulation may have a partially water-soluble solvent content of between about 70 percent by weight and about 95 percent by weight. For example, the second liquid formulation may have a partially water-soluble solvent content of between about 70 percent by weight and about 92 percent by weight or between about 70 percent by weight and about 90 percent by weight.

The second liquid formulation may have a partially water-soluble solvent content of between about 75 percent by weight and about 95 percent by weight. For example, the second liquid formulation may have a partially water-soluble solvent content of between about 75 percent by weight and about 92 percent by weight or between about 75 percent by weight and about 90 percent by weight.

The second liquid formulation may have a partially water-soluble solvent content of between about 80 percent by weight and about 95 percent by weight. For example, the second liquid formulation may have a partially water-soluble solvent content of between about 80 percent by weight and about 92 percent by weight or between about 80 percent by weight and about 90 percent by weight.

Preferably, the one or more partially water-soluble solvents are selected from the group consisting of polysorbate 80, triethyl citrate and triacetin.

More preferably, the one or more partially water-soluble solvents are selected from the group consisting of triethyl citrate and triacetin.

The one or more water-immiscible solvents may comprise one or more water-insoluble solvents.

As used herein with reference to the invention, the term "water-insoluble solvent" describes a compound that is liquid at 20° C. and has a water solubility at 20° C. of less than or equal to about 5 mg/ml.

The second liquid formulation may have a water-insoluble solvent content of greater than or equal to about 55 percent by weight, greater than or equal to about 60 percent by weight or greater than or equal to about 65 percent by weight. For example, the second liquid formulation may have a water-insoluble solvent content of greater than or equal to about 70 percent by weight, greater than or equal to about 75 percent by weight or greater than or equal to about 80 percent by weight.

The second liquid formulation may have a water-insoluble solvent content of less than or equal to about 95 percent by weight, less than or equal to about 92 percent by weight or less than or equal to about 90 percent by weight.

The second liquid formulation may have a water-insoluble solvent content of between about 55 percent by weight and about 95 percent by weight. For example, the second liquid formulation may have a water-insoluble solvent content of between about 55 percent by weight and about 92 percent by weight or between about 55 percent by weight and about 90 percent by weight.

The second liquid formulation may have a water-insoluble solvent content of between about 60 percent by weight and about 95 percent by weight. For example, the second liquid formulation may have a water-insoluble solvent content of between about 60 percent by weight and about 92 percent by weight or between about 60 percent by weight and about 90 percent by weight.

The second liquid formulation may have a water-insoluble solvent content of between about 65 percent by weight and about 95 percent by weight. For example, the second liquid formulation may have a water-insoluble solvent content of between about 65 percent by weight and about 92 percent by weight or between about 65 percent by weight and about 90 percent by weight.

The second liquid formulation may have a water-insoluble solvent content of between about 70 percent by weight and about 95 percent by weight. For example, the second liquid formulation may have a water-insoluble solvent content of between about 70 percent by weight and about 92 percent by weight or between about 70 percent by weight and about 90 percent by weight.

The second liquid formulation may have a water-insoluble solvent content of between about 75 percent by weight and about 95 percent by weight. For example, the second liquid formulation may have a water-insoluble solvent content of between about 75 percent by weight and about 92 percent by weight or between about 75 percent by weight and about 90 percent by weight.

The second liquid formulation may have a water-insoluble solvent content of between about 80 percent by weight and about 95 percent by weight. For example, the second liquid formulation may have a water-insoluble solvent content of between about 80 percent by weight and about 92 percent by weight or between about 80 percent by weight and about 90 percent by weight.

Preferably, the one or more water-insoluble solvents are selected from the group consisting of oleic acid and MIGLYOL® (mixture of decanoyl- and octanoyl glycerides).

The second liquid formulation may comprise nicotine.

The second liquid formulation may comprise natural nicotine or synthetic nicotine.

The second liquid formulation may have a nicotine content of greater than or equal to about 0.5 percent by weight or greater than or equal to about 1 percent by weight.

In embodiments in which the second liquid formulation comprises nicotine, preferably the second liquid formulation has a nicotine content of greater than or equal to about 1.5 percent by weight. More preferably, the second liquid formulation has a nicotine content of greater than or equal to about 2 percent by weight.

The second liquid formulation may have a nicotine content of greater than or equal to about 2.5 percent by weight.

The second liquid formulation may have a nicotine content of less than or equal to about 14 percent by weight or less than or equal to about 12 percent by weight.

Preferably, the second liquid formulation has a nicotine content of less than or equal to about 10 percent by weight. More preferably, the second liquid formulation has a nicotine content of less than or equal to about 8 percent by weight.

The second liquid formulation may have a nicotine content of less than or equal to about 7 percent by weight.

The second liquid formulation may have a nicotine content of between about 0.5 percent by weight and about 14 percent by weight. For example, the second liquid formulation may have a nicotine content of between about 0.5 percent by weight and about 12 percent by weight, between about 0.5 percent by weight and about 10 percent by weight, between about 0.5 percent by weight and about 8 percent by weight or between about 0.5 percent by weight and about 7 percent by weight.

The second liquid formulation may have a nicotine content of between about 1 percent by weight and about 14 percent by weight. For example, the second liquid formulation may have a nicotine content of between about 1 percent by weight and about 12 percent by weight, between about 1 percent by weight and about 10 percent by weight, between about 1 percent by weight and about 8 percent by weight or between about 1 percent by weight and about 7 percent by weight.

Preferably, the second liquid formulation has a nicotine content of between about 1.5 percent by weight and about 14 percent by weight. For example, the second liquid formulation may have a nicotine content of between about 1.5 percent by weight and about 12 percent by weight, between about 1.5 percent by weight and about 10 percent by weight, between about 1.5 percent by weight and about 8 percent by weight or between about 1.5 percent by weight and about 7 percent by weight.

More preferably, the second liquid formulation has a nicotine content of between about 2 percent by weight and about 14 percent by weight. For example, the second liquid formulation may have a nicotine content of between about 2 percent by weight and about 12 percent by weight, between about 2 percent by weight and about 10 percent by weight, between about 2 percent by weight and about 8 percent by weight or between about 2 percent by weight and about 7 percent by weight.

The second liquid formulation may have a nicotine content of between about 2.5 percent by weight and about 14 percent by weight. For example, the second liquid formulation may have a nicotine content of between about 2.5 percent by weight and about 12 percent by weight, between about 2.5 percent by weight and about 10 percent by weight, between about 2.5 percent by weight and about 8 percent by weight or between about 2.5 percent by weight and about 7 percent by weight.

The first liquid formulation and the second liquid formulation may both comprise nicotine.

Preferably, the second liquid formulation comprises one or more flavourants.

The second liquid formulation may comprise one or more non-polar hydrophobic flavourants.

The second liquid formulation may comprise one or more hydrophobic flavourants.

The second liquid formulation may comprise one or more non-polar flavourants and one or hydrophobic flavourants.

Suitable flavourants for inclusion in the second liquid formulation include, but are not limited to, alpha-pinene, beta-ionone, camphor, citral, citronellal and menthol.

The second liquid formulation comprises one or more flavourants, the second liquid formulation may a flavourant content of less than or equal to about 20 percent by weight or less than or equal to about 15 percent by weight. For example, the second liquid formulation may have a flavourant content of less than or equal to about 10 percent by weight, less than or equal to about 8 percent by weight or less than or equal to about 6 percent by weight.

The amount of first liquid formulation and the amount of second liquid formulation in the cartridge and aerosol-generating system according to the invention may be selected and balanced to achieve an appropriate aerosol.

The ratio of first liquid formulation to second liquid formulation required to generate an appropriate aerosol may be controlled and balanced through variation of the ratio of the weight percent first liquid formulation content to the weight percent second liquid formulation content of the cartridge and aerosol-generating system according to the invention.

The ratio of the weight percent first liquid formulation content to the weight percent second liquid formulation content may greater than or equal to about 1. For example, the ratio of the weight percent first liquid formulation content to the weight percent second liquid formulation content may be greater than or equal to about 1.25, greater than or equal to about 1.5 or greater than or equal to about 1.75.

Preferably, the ratio of the weight percent first liquid formulation content to the weight percent second liquid formulation content may greater than or equal to about 2. For example, the ratio of the weight percent first liquid formulation content to the weight percent second liquid formulation content may greater than or equal to about 2.25 or ratio of the weight percent first liquid formulation content to the weight percent second liquid formulation content may greater than or equal to about 2.5.

The cartridge may comprise a first compartment containing the first liquid formulation and a second compartment containing the second liquid formulation.

The ratio of the weight percent first liquid formulation content to the weight percent second liquid formulation content of the cartridge required to generate an appropriate aerosol may be controlled and balanced through variation of the volume of the first compartment relative to the volume of the second compartment.

The first compartment and the second compartment may be arranged in series within the cartridge.

As used herein with reference to the invention, by "in series" it is meant that the first compartment and the second compartment are arranged sequentially within the cartridge so that, in use, an air stream drawn through the cartridge passes through one of the first compartment and the second compartment and then passes through the other of the first compartment and the second compartment. Vapour is released from the first liquid formulation in the first compartment into the air stream drawn through the cartridge and vapour is released from the second liquid formulation in the second compartment into the air stream drawn through the cartridge. The vapour released from the first liquid formulation in the air stream and the vapour released from the second liquid formulation in the air stream mix and condense to form an aerosol.

The second compartment may be located downstream of the first compartment. In such embodiments, in use, an air stream drawn through the cartridge passes through the first compartment and then passes through the second compartment.

In use, the vapour released from the first liquid formulation may mix with the vapour released from the second liquid formulation in the second compartment.

The cartridge may further comprise a third compartment downstream of the second compartment. In such embodiments, in use, the vapour released from the first liquid formulation and the vapour released from the second liquid formulation may mix in the third compartment.

The second compartment may be located upstream of the first compartment. In such embodiments, in use, an air stream drawn through the cartridge passes through the second compartment and then passes through the first compartment.

In use, the vapour released from the second liquid formulation may mix with the vapour released from the first liquid formulation in the first compartment.

The cartridge may further comprise a third compartment downstream of the first compartment. In such embodiments, in use, the vapour released from the second liquid formulation and the vapour released from the first liquid formulation may mix in the third compartment.

The first compartment and the second compartment may be arranged in parallel within the cartridge.

As used herein with reference to the invention, by "in parallel" it is meant that the first compartment and the second compartment are arranged within the cartridge so that in use a first air stream drawn through the cartridge passes through the first compartment and a second air stream drawn through the cartridge passes through the second compartment. Vapour is released from the first liquid formulation in the first compartment into the first air stream drawn through the cartridge and vapour is released from the second liquid formulation in the second compartment into the second air stream drawn through the cartridge. The vapour released from the first liquid formulation in the first air stream and the vapour released from the second liquid formulation in the second air stream mix and condense to form an aerosol.

The cartridge may further comprise a third compartment downstream of the first compartment and the second compartment. In such embodiments, in use, the vapour released from the first liquid formulation in the first air stream and the vapour released from the second liquid formulation in the second air stream may mix in the third compartment.

The cartridge may comprise one or more atomisers configured to generate an aerosol from the first liquid formulation and the second liquid formulation.

A cartridge containing the liquid nicotine formulation and one or more atomisers configured to generate an aerosol from the first liquid formulation and the second liquid formulation may be referred to as a "cartomiser".

The cartridge may comprise a single atomiser configured to generate an aerosol from the first liquid formulation and the second liquid formulation.

The cartridge may comprise two atomisers configured to generate an aerosol from the first liquid formulation and the second liquid formulation.

The cartridge may comprise one or more thermal atomisers.

As used herein with reference to the invention, the term "thermal atomiser" describes an atomiser that is configured to generate vapour from one or both of the first liquid formulation and the second liquid formulation by heating.

The cartridge may comprise a single thermal atomiser configured to heat both the first liquid formulation and the second liquid formulation.

The cartridge may comprise a first thermal atomiser configured to heat the first liquid formulation and a second thermal atomiser configured to heat the second liquid formulation.

The cartridge may comprise one or more thermal atomisers of any suitable type.

The one or more thermal atomisers may each comprise a heater and one or more liquid transport elements configured to transport one or both of the first liquid formulation and the second liquid formulation to the heater.

The cartridge may comprise a single thermal atomiser comprising a heater configured to heat both the first liquid formulation and the second liquid formulation, a first liquid transport element configured to transport the first liquid formulation to the heater and a second liquid transport element configured to transport the second liquid nicotine formulation to the heater.

The cartridge may comprise a first thermal atomiser comprising a first heater configured to heat the first liquid formulation and a first liquid transport element configured to transport the first liquid formulation to the first heater and a second thermal atomiser comprising a second heater configured to heat the second liquid formulation and a second liquid transport element configured to transport the second liquid formulation to the second heater.

The one or more liquid transport elements may each comprise a capillary wick.

The one or more heaters may each comprise a heater coil.

The one or more thermal atomisers may each comprise an electric heater.

The one or more thermal atomisers may each comprise an electric heater comprising a resistive heating element.

The one or more thermal atomisers may each comprise an electric heater comprising an inductive heating element.

The cartridge may comprise one or more non-thermal atomisers.

As used herein with reference to the invention, the term "non-thermal atomiser" describes an atomiser that is configured to generate vapour from one or both of the first liquid formulation and the second liquid formulation by means other than heating.

The cartridge may comprise one or more non-thermal atomisers of any suitable type.

For example, the cartridge may comprise one or more impinging jet atomisers, one or more ultrasonic atomisers or one or more vibrating mesh atomisers.

According to the invention there is also provided an aerosol-generating system comprising: a first liquid formulation comprising at least one of water and one or more water-miscible solvents; a second liquid formulation comprising one or more water-immiscible solvents having a water solubility at 20° C. of less than or equal to about 100 mg/ml, wherein at least one of the first liquid formulation and the second liquid formulation comprises nicotine; and one or more atomisers configured to generate an aerosol from the first liquid formulation and the second liquid formulation.

The aerosol-generating system may comprise a single atomiser configured to generate an aerosol from the first liquid formulation and the second liquid formulation.

The aerosol-generating system may comprise two atomisers configured to generate an aerosol from the first liquid formulation and the second liquid formulation.

The aerosol-generating system may comprise one or more thermal atomisers.

As used herein with reference to the invention, the term "thermal atomiser" describes an atomiser that is configured to generate vapour from one or both of the first liquid formulation and the second liquid formulation by heating.

The aerosol-generating system may comprise a single thermal atomiser configured to heat both the first liquid formulation and the second liquid formulation.

The aerosol-generating system may comprise a first thermal atomiser configured to heat the first liquid formulation and a second thermal atomiser configured to heat the second liquid formulation.

The aerosol-generating system may comprise one or more thermal atomisers of any suitable type.

The one or more thermal atomisers may each comprise a heater and one or more liquid transport elements configured to transport one or both of the first liquid formulation and the second liquid formulation to the heater.

The aerosol-generating system may comprise a single thermal atomiser comprising a heater configured to heat both the first liquid formulation and the second liquid formulation, a first liquid transport element configured to transport the first liquid formulation to the heater and a second liquid transport element configured to transport the second liquid nicotine formulation to the heater.

The aerosol-generating system may comprise a first thermal atomiser comprising a first heater configured to heat the first liquid formulation and a first liquid transport element configured to transport the first liquid formulation to the first heater and a second thermal atomiser comprising a second heater configured to heat the second liquid formulation and a second liquid transport element configured to transport the second liquid formulation to the second heater.

The one or more liquid transport elements may each comprise a capillary wick.

The one or more heaters may each comprise a heater coil.

The one or more thermal atomisers may each comprise an electric heater.

The one or more thermal atomisers may each comprise an electric heater comprising a resistive heating element.

The one or more thermal atomisers may each comprise an electric heater comprising an inductive heating element.

The aerosol-generating system may comprise one or more non-thermal atomisers.

As used herein with reference to the invention, the term "non-thermal atomiser" describes an atomiser that is configured to generate vapour from one or both of the first liquid formulation and the second liquid formulation by means other than heating.

The aerosol-generating system may comprise one or more non-thermal atomisers of any suitable type.

For example, the aerosol-generating system may comprise one or more impinging jet atomisers, one or more ultrasonic atomisers or one or more vibrating mesh atomisers.

The aerosol-generating system may comprise: a cartridge according to the invention containing the first liquid formulation and the second liquid formulation; and an aerosol-generating device comprising a housing defining a device cavity configured to receive at least a portion of the cartridge.

The aerosol-generating system may comprise: a cartridge according to the invention containing the first liquid formulation and the second liquid formulation; and an aerosol-generating device.

The aerosol-generating device may comprise a battery and control electronics.

The aerosol-generating device may comprise a housing defining a device cavity configured to receive at least a portion of the cartridge.

The aerosol-generating system may comprise: a consumable cartridge according to the invention containing the first liquid formulation and the second liquid formulation; and a reusable aerosol-generating device.

The aerosol-generating system may comprise: a cartridge according to the invention containing the first liquid formulation and the second liquid formulation and one or more atomisers configured to generate an aerosol from the first liquid formulation and the second liquid formulation; and an aerosol-generating device.

The aerosol-generating system may comprise: a cartridge according to the invention containing the first liquid formulation and the second liquid formulation; and an aerosol-generating device comprising one or more atomisers configured to generate an aerosol from the first liquid formulation and the second liquid formulation contained in the cartridge.

For the avoidance of doubt, features described above in relation to the cartridge of the invention may also relate, where appropriate, to the aerosol-generating system of the invention, and vice versa.

Figure 1B:
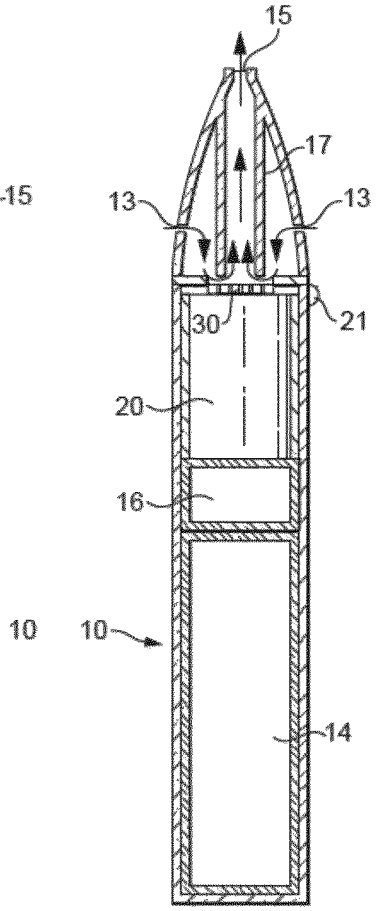
Figure 2A:
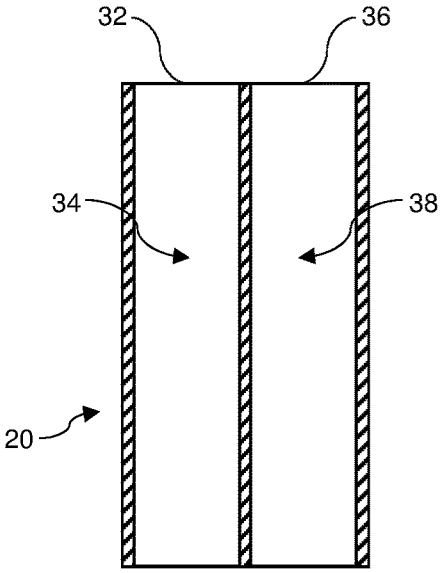
Figure 2B:
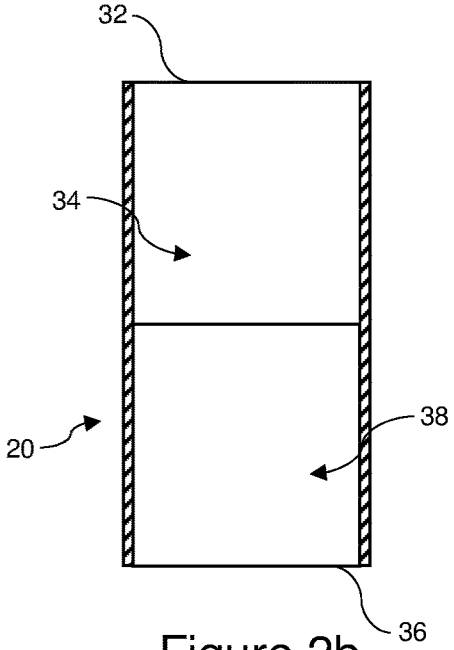

The invention will now be described, by way of example only, with reference to the following examples and accompanying drawings, in which:

FIG. 1*a* shows a schematic illustration of an aerosol-generating system comprising an aerosol-generating device and a cartridge being inserted into the aerosol-generating device;

FIG. 1*b* shows a schematic illustration of the aerosol-generating system of FIG. 1*a*, in which the cartridge is received in the aerosol-generating device; and FIG. 2*a* shows a schematic illustration of a cartridge comprising a first compartment containing a first liquid formulation and a second compartment containing a second liquid formulation, wherein the first compartment and the second compartment are arranged in series within the cartridge; and FIG. 2*b* shows a schematic illustration of a cartridge comprising a first compartment containing a first liquid formulation and a second compartment containing a second liquid formulation, wherein the first compartment and the second compartment are arranged in parallel within the cartridge.

FIGS. 1*a* and 1*b* are schematic illustrations of an exemplary aerosol-generating system according to the invention. The aerosol-generating system shown in FIGS. 1*a* and 1*b* is like that disclosed in WO 2015/117702 A1 and comprises an aerosol-generating device 10 and a cartridge 20.

The aerosol-generating device 10 is portable and has a size comparable to a conventional cigar or cigarette. The aerosol-generating device 10 comprises a main body 11 and a mouthpiece portion 12. The main body 11 contains a battery 14 and control electronics 16. The main body 11 defines a device cavity 18 configured to receive the cartridge 20.

The device cavity 18 is of substantially circular transverse cross-section and is sized to receive the cartridge 20. Electrical connectors 19 are provided at the sides of the device cavity 18 to provide an electrical connection between the control electronics 16 and the battery 14 and corresponding electrical contacts provided on the cartridge 20.

The mouthpiece portion 12 is connected to the main body 11 by a hinged connection 21 and can move between an open position as shown in FIG. 1*a* and a closed position as shown in FIG. 1*b*. The mouthpiece portion 12 is placed in the open position to allow for insertion and removal of the cartridge 20 from the aerosol-generating device 10 and is placed in the closed position when the aerosol-generating system is to be used to generate an aerosol, as described below. The mouthpiece portion 12 comprises a plurality of air inlets 13 and an outlet 15. In use, a user draws on the outlet 15 to draw air into the mouthpiece portion 12 through the air inlets 13, through the mouthpiece portion to the outlet 15, and thereafter into the mouth and lungs of the user. As shown in FIGS. 1*a* and 1*b*, internal baffles 17 are provided to force the air flowing through the mouthpiece portion 12 past the cartridge 20.

FIG. 1*a* shows the cartridge 20 just prior to insertion into the aerosol-generating device 10, with the arrow 1 in FIG. 1*a* indicating the direction of insertion of the cartridge 20.

The cartridge 20 contains a first liquid formulation and a second liquid formulation. The cartridge 20 is replaceable by a user when the first liquid formulation and the second liquid formulation contained in the cartridge 20 are depleted. The cartridge 20 comprises a generally circular cylindrical housing 24 that has a size and shape selected to be received into the device cavity 18. In this example the first liquid formulation comprises 38 percent by weight water, 38 percent by weight glycerine, 19 percent by weight propylene glycol, 2 percent by weight nicotine and 3 percent by weight lactic acid and the second liquid formulation comprises 85 percent by weight triacetin and 15 percent by weight flavourant.

The housing 24 has an open end to which an atomiser comprising a heater assembly 30 is fixed. The heater assembly 30 comprises a substrate having an aperture formed in it, a pair of electrical contacts fixed to the substrate and separated from each other by a gap, and a plurality of electrically conductive heater filaments spanning the aperture and fixed to the electrical contacts on opposite sides of the aperture.

The heater assembly 30 is covered by a removable cover 26 that is secured to the heater assembly 30. The removable cover 26 is liquid impermeable and is configured to be removed from the heater assembly 30 by a user prior to use of the aerosol-generating system. The removable cover 26 may be secured to the heater assembly 30 by any suitable means. Suitable means include, but are not limited to, adhesive bonding, thermal bonding, such as for example, laser bonding and ultrasonic welding, and combinations thereof. As shown in FIG. 1*a*, the removable cover 26 is provided with a pull tab to facilitate removal of the removable cover 26 by a user prior to use of the aerosol-generating system.

In use, with the mouthpiece portion 12 of the aerosol-generating device 10 in the open position shown in FIG. 1*a*, the cartridge 20 is inserted into the device cavity 18 of the aerosol-generating device 10 and the removable cover 26 is removed from the cartridge 10. Once the cover 26 has been removed, the heater filaments are exposed through the aperture in the substrate so that vaporised first liquid formulation and vaporised second liquid formulation can escape into the air flow past the heater assembly 30.

In this position, the electrical connectors 19 provided at the sides of the device cavity 18 rest against the electrical contacts provided on the cartridge 20. The mouthpiece portion 12 is then moved to the closed position shown in FIG. 1*b*. The mouthpiece portion 12 is retained in the closed position by a clasp mechanism (not shown).

In the closed position the mouthpiece portion 12 of the aerosol-generating device 10 retains the cartridge 20 in electrical contact with the electrical connectors 19 provided at the sides of the device cavity 18 so that, in use, a good electrical connection is maintained regardless of the orientation of the aerosol-generating system. The mouthpiece portion 12 may include an annular elastomeric element that engages a surface of the cartridge 20 and is compressed between a rigid element of the mouthpiece portion 12 and the cartridge 20 when the mouthpiece portion 12 is in the closed position. This may ensure that a good electrical connection is maintained despite manufacturing tolerances. Other mechanisms for maintaining a good electrical connection between the cartridge and the device may be employed.

In use the heater assembly 30 operates by resistive heating. Current is passed through the heater filaments under the control of control electronics 16, to heat the heater filaments to within a desired temperature range.

The air flow through the mouthpiece portion 12 when the aerosol-generating system is used is illustrated in FIG. 1*d*. The mouthpiece portion 12 includes internal baffles 17, which are integrally moulded with the external walls of the mouthpiece portion and ensure that, as air is drawn from the air inlets 13 to the outlet 15, it flows over the heater assembly 30 on the cartridge 10 where first liquid formulation and second liquid formulation are being vaporised. As the air passes the heater assembly 30, vaporised first liquid formulation and vaporised second liquid formulation are entrained in the airflow and cool to form an aerosol before exiting through the outlet 15. Accordingly, in use, the first liquid formulation and the second liquid formulation pass through the heater assembly 30 by passing through interstices between the heater filaments as they are vaporised.

FIGS. 2*a* and 2*b* are schematic illustrations of exemplary cartridges according to the invention. The cartridges 20 shown in FIGS. 2*a* and 2*b* each comprise a first compartment 32 containing a first liquid formulation 34 and a second compartment 36 containing a second liquid formulation 38. The first liquid formulation 34 comprises at least one of water and one or more water-miscible solvents. The second liquid formulation 38 comprises one or more water-immiscible solvents having a water solubility at 20° C. of less than or equal to about 100 mg/ml. At least one of the first liquid formulation 34 and the second liquid formulation 38 comprises nicotine. The first compartment 32 and the second compartment 36 of the cartridge 20 shown in FIG. 2*a* are arranged in parallel within the cartridge 20. The first compartment 32 and the second compartment 36 of the cartridge 20 shown in FIG. 2*b* are arranged in series within the cartridge 20.

EXAMPLES

Six cartridges according to the invention are prepared containing first liquid formulations and second liquid formulations having the compositions shown in Table 2 to 6:

TABLE 2

| First liquid formulation: | | |
|---|---|---|
| Mass (mg) | | 1.54 |
| Water (% by weight) | | 38.2 |
| Vegetable Glycerine (% by weight) | water-miscible solvent | 38.2 |

TABLE 2-continued

| | | |
|---|---|---|
| Propylene Glycol (% by weight) | | 18.1 |
| Nicotine (% by weight) | | 2.4 |
| Lactic Acid (% by weight) | water-soluble organic acid | 3.1 |
| Second liquid formulation: | | |
| Mass (mg) | | 0.62 |
| Triethyl Citrate (% by weight) | water-immiscible solvent | 85 |
| Flavourant (% by weight) | | 15 |

TABLE 3

| | | |
|---|---|---|
| First liquid formulation: | | |
| Mass (mg) | | 1.54 |
| Water (% by weight) | | 38.2 |
| Vegetable Glycerine (% by weight) | water-miscible solvent | 38.2 |
| Propylene Glycol (% by weight) | | 18.1 |
| Nicotine (% by weight) | | 2.4 |
| Lactic Acid (% by weight) | water-soluble organic acid | 3.1 |
| Second liquid formulation: | | |
| Mass (mg) | | 0.62 |
| Miglyol (% by weight) | water-immiscible solvent | 85 |
| Flavourant (% by weight) | | 15 |

TABLE 4

| | | |
|---|---|---|
| First liquid formulation: | | |
| Mass (mg) | | 1.54 |
| Water (% by weight) | | 38.2 |
| Vegetable Glycerine (% by weight) | water-miscible solvent | 38.2 |
| Propylene Glycol (% by weight) | | 18.1 |
| Nicotine (% by weight) | | 2.4 |
| Lactic Acid (% by weight) | water-soluble organic acid | 3.1 |
| Second liquid formulation: | | |
| Mass (mg) | | 0.62 |
| Triacetin (% by weight) | water-immiscible solvent | 90 |
| Flavourant (% by weight) | | 10 |

TABLE 5

| | | |
|---|---|---|
| First liquid formulation: | | |
| Mass (mg) | | 1.56 |
| Water (% by weight) | | 39.1 |
| Vegetable Glycerine (% by weight) | water-miscible solvent | 39.1 |
| Propylene Glycol (% by weight) | | 18.5 |
| Lactic Acid (% by weight) | water-soluble organic acid | 3.2 |
| Second liquid formulation: | | |
| Mass (mg) | | 0.66 |
| Triethyl Citrate (% by weight) | water-immiscible solvent | 88.2 |
| Nicotine (% by weight) | | 5.9 |
| Flavourant (% by weight) | | 5.9 |

TABLE 6

| | | |
|---|---|---|
| First liquid formulation: | | |
| Mass (mg) | | 1.58 |
| Water (% by weight) | | 38.7 |
| Vegetable Glycerine (% by weight) | water-miscible solvent | 38.7 |
| Propylene Glycol (% by weight) | | 18.3 |
| Nicotine (% by weight) | | 3.2 |
| Lactic Acid (% by weight) | water-soluble organic acid | 1.2 |

TABLE 6-continued

| | | |
|---|---|---|
| Second liquid formulation: | | |
| Mass (mg) | | 0.64 |
| Triethyl Citrate (% by weight) | water-immiscible solvent | 90.9 |
| Nicotine (% by weight) | | 3.0 |
| Flavourant (% by weight) | | 6.1 |

The invention claimed is:

1. A cartridge for an aerosol-generating system, the cartridge comprising:

a first compartment containing a first liquid formulation comprising at least one of water and one or more water-miscible solvents; and a second compartment containing a second liquid formulation comprising one or more water-immiscible solvents having a water solubility at 20° C. of less than or equal to about 100 mg/ml, wherein the first liquid formulation and the second liquid formulation are distinct liquid formulations, wherein the first liquid formulation and the second liquid formulation are precluded from mixing in the cartridge prior to vaporization, and wherein at least one of the first liquid formulation and the second liquid formulation comprises nicotine.

2. The cartridge according to claim 1, wherein the first liquid formulation has a total water and water-miscible solvent content of greater than or equal to about 75 percent by weight.

3. The cartridge according to claim 1, wherein the first liquid formulation comprises water and one or more water-miscible solvents.

4. The cartridge according to claim 1, wherein the one or more water-miscible solvents are one or more water-miscible polyhydric alcohols selected from the group consisting of 1,3-butanediol, glycerine, propylene glycol, and triethylene glycol.

5. The cartridge according to claim 1, wherein the first liquid formulation comprises one or more water-soluble organic acids.

6. The cartridge according to claim 5, wherein the one or more water-soluble organic acids are selected from the group consisting of acetic acid, lactic acid, levulinic acid, and pyruvic acid.

7. The cartridge according to claim 5, wherein the first liquid formulation has a water-soluble organic acid content of greater than or equal to about 2 percent by weight.

8. The cartridge according to claim 1, wherein the second liquid formulation has a water-immiscible solvent content of greater than or equal to about 70 percent by weight.

9. The cartridge according to claim 1, wherein the one or more water-immiscible solvents are selected from the group consisting of polysorbate 80, triacetin, triethyl citrate, oleic acid, and a mixture of decanoyl- and octanoyl glycerides.

10. The cartridge according to claim 1, wherein the one or more water-immiscible solvents comprise one or more partially water-soluble solvents having a water solubility at 20° C. of between about 20 mg/ml and about 100 mg/ml.

11. The cartridge according to claim 1, wherein the one or more water-immiscible solvents comprise one or more water-insoluble solvents having a water solubility at 20° C. of less than or equal to about 5 mg/ml.

12. The cartridge according to claim 1, wherein the second liquid formulation comprises one or more flavourants.

13. The cartridge according to claim 1, wherein a ratio of a weight percent first liquid formulation content to a weight percent second liquid formulation content of the cartridge is greater than or equal to about 2.

14. The cartridge according to claim 1, further comprising one or more atomizers configured to generate an aerosol from the first liquid formulation and the second liquid formulation.

15. An aerosol-generating system, comprising:

a cartridge according to claim 1; and an aerosol-generating device comprising one or more atomizers configured to generate an aerosol from the first liquid formulation and the second liquid formulation contained in the cartridge.

* * * * *